US007887215B2

(12) United States Patent
Petzl et al.

(10) Patent No.: US 7,887,215 B2
(45) Date of Patent: Feb. 15, 2011

(54) PORTABLE LAMP WITH BACK-SURFACE MOUNTED SWITCH AND LIGHT-EMITTING DIODES

(75) Inventors: Paul Petzl, Barraux (FR); Stéphane Huguenin, Grenoble (FR); Nicolas Florès, Echirolles (FR)

(73) Assignee: Zedel, Crolles (FR)

( * ) Notice: Subject to any disclaimer, the term of this patent is extended or adjusted under 35 U.S.C. 154(b) by 139 days.

(21) Appl. No.: 12/230,668

(22) Filed: Sep. 3, 2008

(65) Prior Publication Data

US 2009/0103289 A1 Apr. 23, 2009

(30) Foreign Application Priority Data

Oct. 23, 2007 (FR) ..... 07 07434

(51) Int. Cl.
*F21L 4/00* (2006.01)

(52) U.S. Cl. ..... 362/208; 362/184; 362/249.05; 200/60

(58) Field of Classification Search ..... 362/184, 362/208, 249.02, 249.05, 249.1; 200/60
See application file for complete search history.

(56) References Cited

U.S. PATENT DOCUMENTS 2,831,282 A * 4/1958 Hardesty ..... 40/546
4,308,572 A * 12/1981 Davidson et al. ..... 362/103
4,523,258 A * 6/1985 Morse et al. ..... 362/108
5,552,964 A * 9/1996 Naito ..... 361/781
5,927,842 A * 7/1999 Preisler ..... 362/103
6,499,859 B2 * 12/2002 Petzl et al. ..... 362/184
7,674,013 B2 * 3/2010 Leslie et al. ..... 362/249.05
2002/0136006 A1 9/2002 Altman
2003/0090892 A1 * 5/2003 Su ..... 362/101
2004/0246705 A1 * 12/2004 Lu ..... 362/101
2006/0067077 A1 * 3/2006 Kumthampinij et al. .... 362/294
2006/0072310 A1 * 4/2006 Hung ..... 362/205
2006/0203477 A1 9/2006 Chien
2007/0019405 A1 * 1/2007 Chang et al. ..... 362/192
2007/0235308 A1 10/2007 Sharrah
2008/0266839 A1 * 10/2008 Claypool et al. ..... 362/106

FOREIGN PATENT DOCUMENTS

DE 93 02 212.3 U1 4/1993
DE 202 08 203 U1 10/2003
DE 20 2007 010 178 A1 9/2007

* cited by examiner

*Primary Examiner*—Ismael Negron
(74) *Attorney, Agent, or Firm*—Oliff & Berridge

(57) ABSTRACT

A portable lamp comprising an electric power supply module and a lighting module arranged in a triangular architecture. The lighting module comprises a printed circuit on one surface of which at least one LED and a switch are fitted. The top surface of the switch comprises a pushbutton placed against a first surface of the printed circuit. The printed circuit comprises a through hole leaving the pushbutton accessible via a second surface of the printed circuit.

3 Claims, 4 Drawing Sheets

PORTABLE LAMP WITH BACK-SURFACE MOUNTED SWITCH AND LIGHT-EMITTING DIODES

BACKGROUND OF THE INVENTION

The invention relates to a portable lamp comprising a case housing an electric power source and a lighting module equipped with a printed circuit, at least one light-emitting diode and a switch provided with an actuating pushbutton being arranged on a first surface of this circuit.

STATE OF THE ART

Portable lamps have to comply with compactness criteria, a switch used to achieve such lamps is relatively bulky. The position of the switch has a direct influence on the global volume of the lamp. To limit the global volume of the lamp as far as possible, the lamp presents a triangular architecture. A triangular architecture is composed of three walls, a first wall acting as support for an electric power supply, a second wall on which a button for lighting the lamp corresponding to the switch is located, and a third wall comprising an optic system which can be composed of a lens. The global volume of the lamp depends on the depth of the lighting module comprising the switch, a printed circuit and at least one LED. For a lamp with a triangular architecture, the switch must be placed as far to the rear as possible, near the electric power source and as close as possible to the second wall.

Different embodiments of the lighting module are known from the prior art. A perpendicular mode, as represented in FIG. 1, imposes movement of the switch towards the front of the lamp as represented in FIG. 2, this being due to integration of the printed circuit board 5'. The portable lamp obtained therefore has a large depth. This architecture is not optimal from the point of view of its overall dimensions. FIG. 1 illustrates a switch 4' with side extending contacts. Another embodiment of the lighting module consists in mounting the switch flat on printed circuit board 5'. FIG. 3 illustrates a switch 4" with contacts 13' extending parallel to the switch 4". As illustrated in FIG. 3, the printed circuit is placed under the switch enabling the depth of the lamp to be optimized. However, such an assembly implies constraints on the location of the LEDs. FIGS. 4-6 illustrate a switch 4''' with backside extending contacts. The constraints concerning the location of the LEDs can be seen in FIGS. 4, 5 and 6—they are too high in FIG. 6, too low in FIG. 5 or too far forwards in FIG. 4. This architecture is therefore not satisfactory for good integration of the LEDs with the optic system of the lamp.

The document US2006/0203477 describes a torchlight comprising a hollow elongate cylindrical body provided at one end thereof with a lighting module comprising a plurality of LEDs. An integrated circuit on which a pushbutton is connected is housed inside the cylindrical body. This type of torchlight is bulky and cannot easily be used as a headlamp as portable lamps with triangular architecture can be. Due to the nature of the elongate cylindrical body, integration problems due to the location of the pushbutton do not exist.

OBJECT OF THE INVENTION

The object of the invention is to overcome the drawbacks of known devices, in particular as far as a portable lamp is concerned to limit the depth of the latter and to enable compact assembly of the lamp while keeping a flexibility for location of the LEDs.

This object is achieved by the fact that the printed circuit comprises a through hole and that the switch is arranged against said first surface of the printed circuit after the pushbutton has passed through said hole. Association of the switch and of the printed circuit thereby enables the location of the LEDs to be optimized when the lighting module is fitted in the case of the lamp and enables the size of the case to be reduced.

According to a preferred embodiment, the pushbutton and the hole of the integrated circuit are coaxial, the lighting module is integrated in a triangular lamp architecture with three walls enabling a lamp of minimal overall volume to be obtained while at the same time using conventional components such as switches comprising strips folded to form brackets on a lateral surface of said switch.

BRIEF DESCRIPTION OF THE DRAWINGS

Other advantages and features will become more clearly apparent from the following description of particular embodiments of the invention given for non-restrictive example purposes only and represented in the accompanying drawings, in which.

DESCRIPTION OF THE PREFERRED EMBODIMENTS OF THE INVENTION

Figure 1:
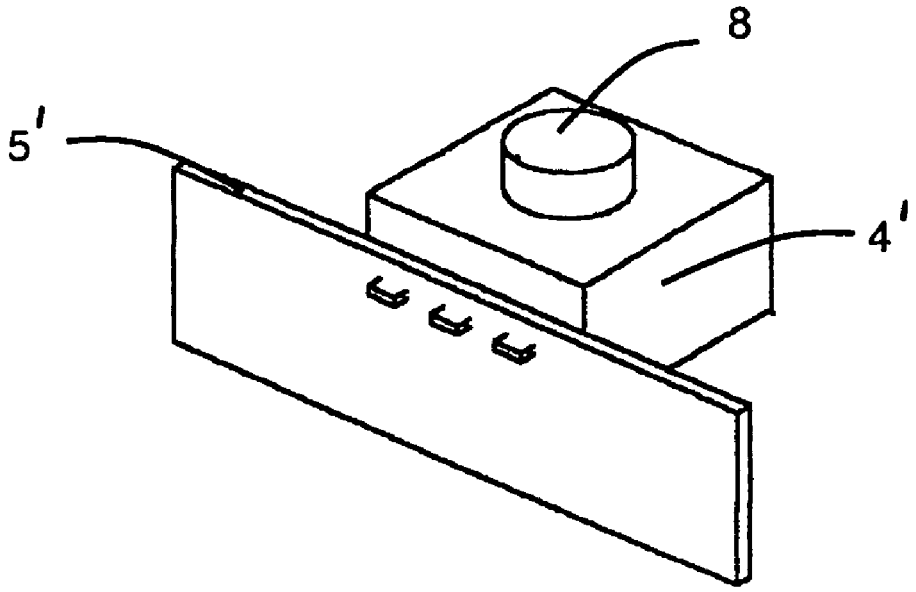
Figure 1 (prior art)
FIG. 1 illustrates a printed circuit with pushbutton fitted perpendicularly according to the prior art.
Figure 2:
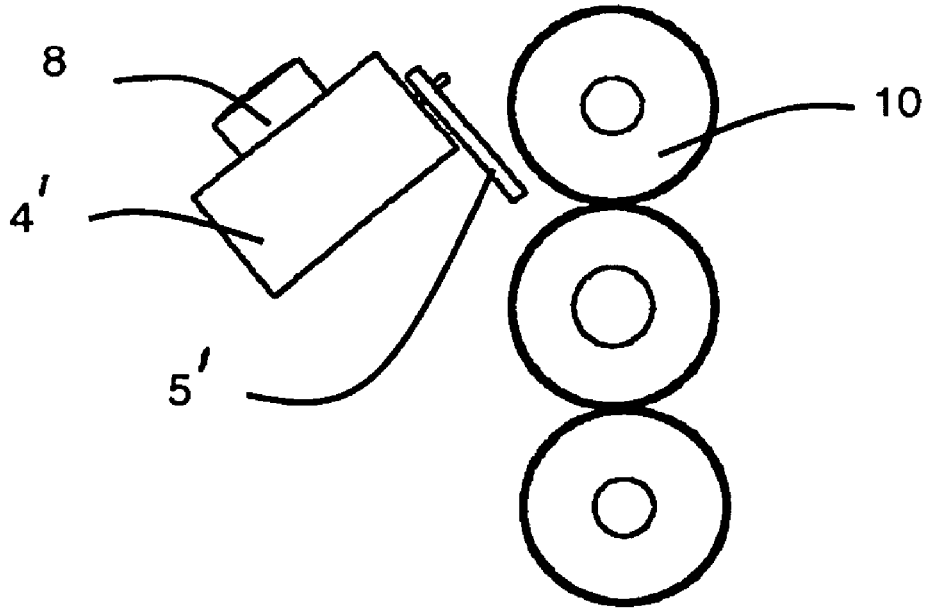
Figure 2 (prior art)
FIG. 2 illustrates the positioning of the lighting module fitted perpendicularly in a case according to the prior art.
Figure 3:
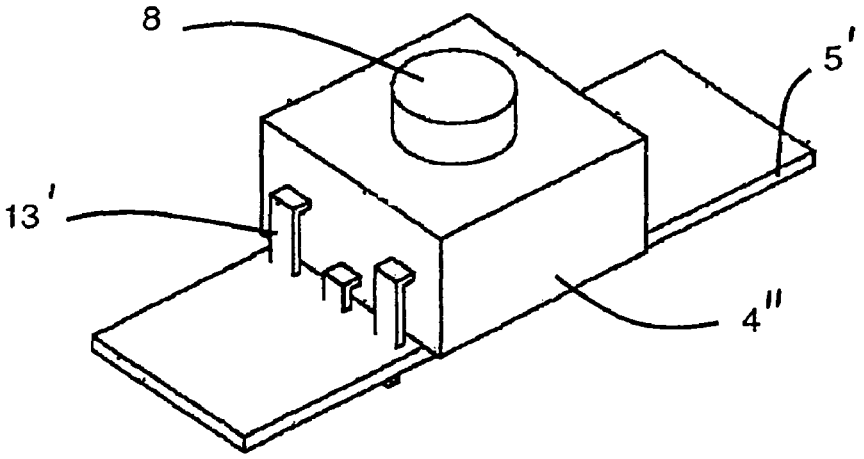
Figure 3 (prior art)
FIG. 3 illustrates a printed circuit with pushbutton fitted flat according to the prior art.
Figure 4:
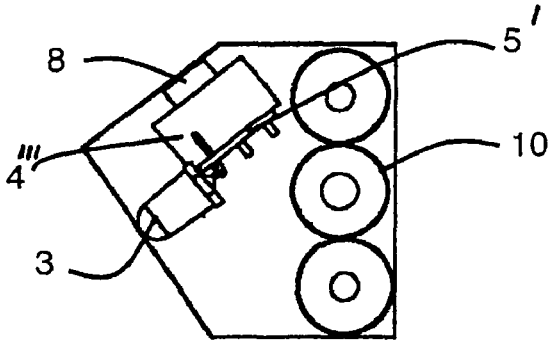
Figure 4 (prior art)
FIGS. 4, 5, 6 illustrate the possibilities of arrangement of the lighting module fitted flat in a case according to the prior art.
Figure 5:
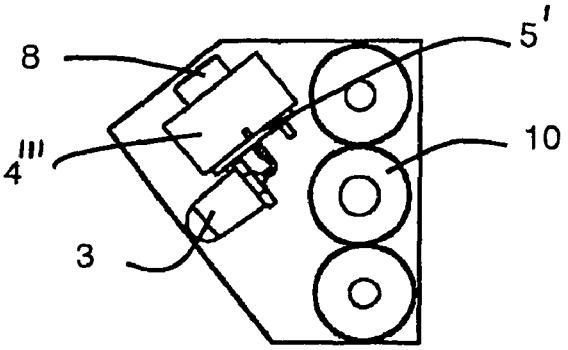
Figure 5 (prior art)
Figure 6:
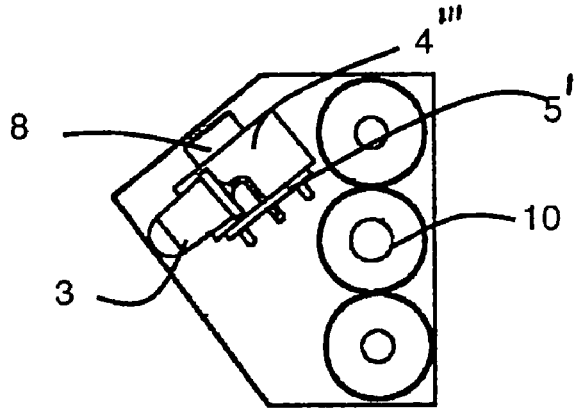
Figure 6 (prior art)
Figure 7:
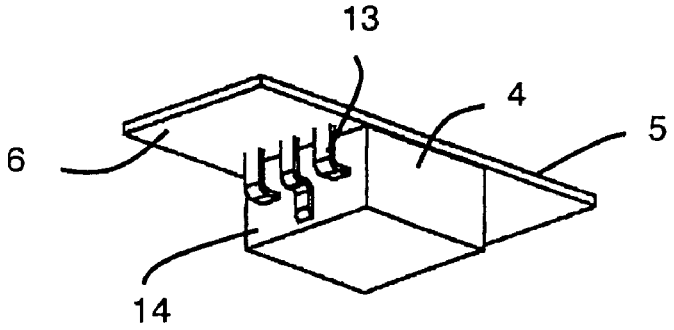
FIG. 7 illustrates a printed circuit with a pushbutton fitted on a first surface of the printed circuit, seen from this first surface.
Figure 8:
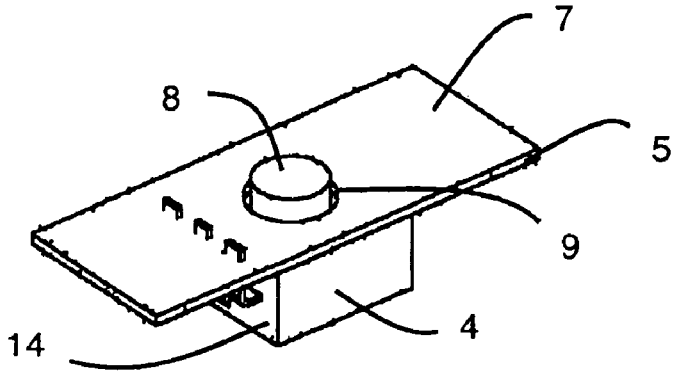
FIG. 8 illustrates a printed circuit with a pushbutton fitted on a first surface of the printed circuit, seen from a second surface of the printed circuit.
Figure 9:
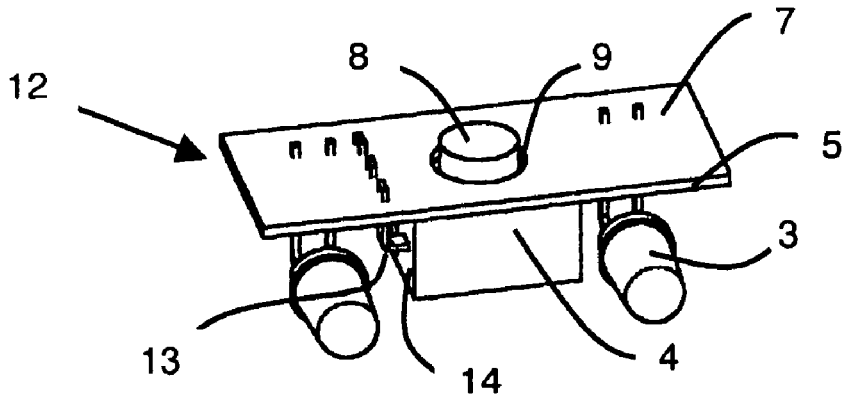
FIG. 9 illustrates a lighting module according to the invention.
Figure 10:
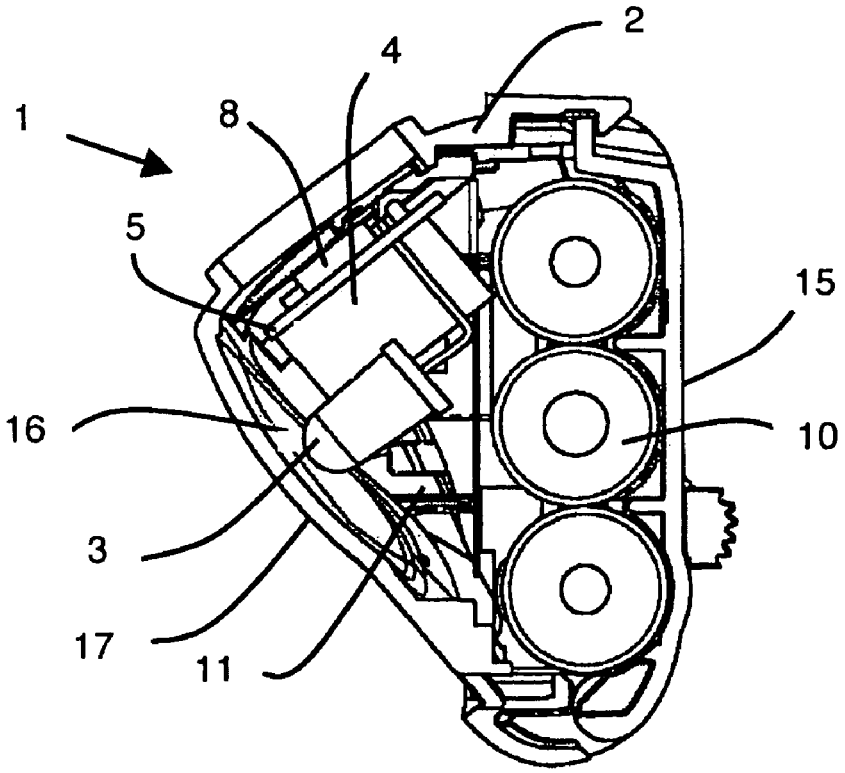
FIG. 10 illustrates a portable lighting lamp according to the invention.

With reference to FIGS. 9 and 10, a portable lamp comprises a case 1 made of molded plastic material housing a lighting module 12 and an electric power source 10. Lighting module 12 comprises a printed circuit 5 on which a through hole 9 is made. According to FIGS. 7 and 8, the switch 4 and LED 3 components are fitted on a first surface 6 of the printed circuit 5 and can be soldered onto a second face 7 of said printed circuit 5. Switch 4 has a top surface and side surfaces, an actuating pushbutton 8 being located on the top surface and connecting strips 13 being located on one of the side faces 14. The top surface of switch 4 is facing first surface 6 of printed circuit 5. Pushbutton 8 and hole 9 of printed circuit 5 can be coaxial enabling pushbutton 8 to be accessed via hole 9 of printed circuit 5 or to let said pushbutton 8 pass through hole 9.

A lighting module 12 as defined above can be integrated in a lamp with a triangular architecture illustrated in FIG. 10. In this case, power source 10 formed for example by disposable or rechargeable batteries is placed against a first wall 15 of case 1, second surface 7 of printed circuit 5 is placed against a second top wall 2 of case 1 leaving pushbutton 8 accessible from the outside of case 1. This leaves all the available space to arrange LEDs 3, without any internal stress on case 1, in a cavity 11 of case 1, facing an optic system 16 which can be formed for example by a single lens, a Fresnel lens, a simple protective glass or no protection. Optic system 16 is placed on a third wall 17 of case 1. Cavity 11 is defined by the space left in case 1 by achievement of the triangular architecture.

Another advantage of this embodiment is that standard switches 4, comprising connecting strips 13 on a side face 14, can be used. Strips 13 of switch 4 are folded to form brackets when the lighting module is manufactured so as to be able to fit said switch 4 on first surface 6 of printed circuit 5.

Switch 4 can comprise three positions—off, strong lighting, and weak lighting, enabling the lighting to be adjusted according to the outside conditions.

The invention claimed is:

1. A portable lamp comprising a case housing an electric power source, an optics system and a lighting module equipped with a printed circuit, at least one light-emitting diode and a switch provided with an actuating pushbutton being arranged on a first surface of the printed circuit, wherein the printed circuit comprises a through hole and the switch is arranged against said first surface of the printed circuit after the pushbutton has passed through said hole, the switch comprises strips folded to form brackets on a side surface of the switch, and the case comprises a first wall acting as support for the electric power supply, a second wall extending parallel to the printed circuit on the pushbutton side and a third wall for housing the optic system.

2. The portable lamp according to claim 1, wherein the pushbutton and said hole are coaxial.

3. The portable lamp according to claim 1, wherein the first wall, the second wall and the third wall of the case are connected so as to form a substantially triangular shape in cross-section.

* * * * *